US006739105B2

(12) United States Patent
Fleming

(10) Patent No.: US 6,739,105 B2
(45) Date of Patent: May 25, 2004

(54) CONSTRUCTIONAL ELEMENTS

(75) Inventor: John Joseph Fleming, Cork (IE)

(73) Assignee: Biomedy Limited, Bandon (IE)

( * ) Notice: Subject to any disclaimer, the term of this patent is extended or adjusted under 35 U.S.C. 154(b) by 0 days.

(21) Appl. No.: 10/020,279

(22) Filed: Dec. 18, 2001

(65) Prior Publication Data

US 2002/0062614 A1 May 30, 2002

(30) Foreign Application Priority Data

| | | |
|---|---|---|
| Dec. 22, 2000 | (IE) | 2000/1073 |
| Apr. 20, 2001 | (EP) | 01650043 |
| Jun. 1, 2001 | (IE) | 2001-0521 |
| Oct. 19, 2001 | (IE) | S2001/0920 |

(51) Int. Cl.[7] ..... E04B 2/00

(52) U.S. Cl. ..... 52/513; 52/506.01; 52/506.06; 52/506.05; 52/512; 52/712

(58) Field of Search ..... 52/513, 506.05, 52/512, 481.1, 481.2, 562, 506.01, 506.06, 508, 511, 712–714, 698, 702, 703–4

(56) References Cited

U.S. PATENT DOCUMENTS

| | | | | |
|---|---|---|---|---|
| 2,958,982 A | * | 11/1960 | Baker | 52/241 |
| 4,263,764 A | * | 4/1981 | Wendt | 52/481.2 |
| 4,409,768 A | | 10/1983 | Boden | 52/309 |
| 4,429,508 A | * | 2/1984 | Sizemore | 52/713 |
| 4,674,250 A | | 6/1987 | Altizer | 52/309 |
| 4,875,319 A | | 10/1989 | Hohmann | 52/383 |
| 4,953,334 A | | 9/1990 | Dickens | 52/309 |
| 5,222,335 A | * | 6/1993 | Petrecca | 52/105 |
| 5,440,854 A | | 8/1995 | Hohmann | 52/489 |
| 5,687,538 A | | 11/1997 | Frobosilo et al. | 52/731 |
| 5,743,058 A | * | 4/1998 | Boomsma | 52/481.2 |
| 5,761,873 A | | 6/1998 | Slater | 52/693 |
| 5,799,462 A | | 9/1998 | McKinney | 52/742 |
| 5,816,008 A | * | 10/1998 | Hohmann | 52/565 |
| 5,893,248 A | | 4/1999 | Beliveau | 52/309 |
| 5,956,916 A | | 9/1999 | Liss | 52/655 |
| 6,199,336 B1 | * | 3/2001 | Poliquin | 52/489.1 |
| 6,209,281 B1 | * | 4/2001 | Rice | 52/714 |
| 6,332,300 B1 | * | 12/2001 | Wakai | 52/713 |
| 6,351,922 B1 | * | 3/2002 | Burns et al. | 52/713 |

FOREIGN PATENT DOCUMENTS

| | | | |
|---|---|---|---|
| FR | 2246706 | | 5/1975 |
| FR | 2558502 | | 7/1985 |
| FR | 2665469 | * | 8/1990 |
| GB | 405840 | | 2/1934 |
| GB | 1170492 | | 11/1969 |
| GB | 1592862 | | 7/1981 |
| GB | 2089390 A | | 6/1982 |
| GB | 2163190 A | | 2/1986 |
| GB | 2212835 | * | 8/1989 |

* cited by examiner

*Primary Examiner*—Jeanette Chapman
(74) *Attorney, Agent, or Firm*—Jacobson Holman PLLC

(57) ABSTRACT

A structural panel has a structural frame of interconnected structural members of cold-rolled steel material. EPS insulation is integrally moulded around the structural members to a combined depth of the members and wall tie brackets extending outwardly. There is minimal surface area contact between each bracket and a structural member to minimise cold bridging. Wall ties connect to the brackets by engagement of hooks on the wall ties with slots in the brackets, again with minimal area of contact.

5 Claims, 9 Drawing Sheets

CONSTRUCTIONAL ELEMENTS

FIELD OF THE INVENTION

The invention relates to constructional elements of structural material such as rolled steel.

PRIOR ART DISCUSSION

U.S. Pat. No. 5,799,462 (McKinney) describes a structural panel. The panel has C-shaped structural members on both sides of the panel facing inwardly so that their webs form parts of both opposed surfaces of the panel. The panel also has integral insulation which permanently interlocks the structural members. Also, U.S. Pat. No. 4,953,334 describes a panel having integral insulation and reinforcing structural members.

While these panels appear to have good insulation properties, they also appear to lack structural strength.

Also, it appears that it would be difficult to interconnect them with other constructional elements to provide the required overall structural strength for a building.

A further disadvantage is that it appears that they would significantly lose structural integrity in the event of a fire.

The invention addresses these problems.

SUMMARY OF THE INVENTION

According to the invention, there is provided a structural panel comprising structural members and integrally moulded insulation, characterised in that, the structural members are interconnected independently of the insulation as a structural frame.

Because the structural members are interconnected as a structural frame, the panel does not rely on the strength of the insulation. There is therefore both excellent insulation, and also excellent structural strength even in the event of a fire.

In one embodiment, at least some of the structural members have a cross-sectional shape with a web and a pair of flanges, and the web extends across at least some of the depth of the element.

In another embodiment, the structural frame comprises upper and lower rails interconnected by uprights, and at least one diagonal brace.

In a further embodiment, at least one upright and at least one rail comprise a web and a pair of side flanges, and wherein each upright is connected at each end to a rail by interconnection of the flanges.

In one embodiment, at least one upright fits at each end between the flanges of a rail, and said rail flanges are substantially planar, without a turned-in lip.

In another embodiment, the panel further comprises a plurality of wall tie brackets secured to the frame and each having means for attachment to a wall tie.

In a further embodiment, the brackets extend transversely from the structural frame on an outer side of the panel.

In one embodiment, the insulation extends to the total depth of the frame and the brackets.

In another embodiment, an end face of each bracket is flush with the insulation at an outer surface of the panel.

In a further embodiment, flanges of at least some structural members are flush with the insulation at an inner surface of the panel.

In one embodiment, each bracket comprises a wall-tie-engaging slot extending parallel to the uprights.

In another embodiment, each bracket comprises a shank extending through a structural member flange, and a plug engaging the web of the structural member.

In a further embodiment, the plug comprises a head extending through the web, and a shoulder abutting against the web.

In one embodiment, the insulation is of EPS material.

According to another aspect, there is provided a structural assembly comprising:

a structural panel as defined above;

an elongate floor support suspended from the panel along an upper side edge of the panel; and joists connected to the suspended support and extending transversely from the plane of the panel.

In one embodiment, the suspended support comprises:

a vertical web abutting against an inner surface of the panel;

a top flange extending across a top side edge of the panel and terminating in a lip extending downwardly; and a ledge extending horizontally from the vertical web, said joists resting on the ledge.

In one embodiment, the vertical web comprises a plurality of cut-out tabs extending from the vertical web and each being secured to a joist.

In another embodiment, the assembly comprises a cable duct extending through tab cut-out apertures and insulation in the panel.

According to another aspect, the invention provides a wall tie comprising:

a mortar-engaging outer end;

a shank; and an inner end comprising a hook shaped for engagement in a slot of a wall tie bracket.

In another aspect, the invention provides a wall tie bracket comprising:

an outer end comprising a slot for engagement with a wall tie;

a shank; and an inner end comprising a head and a shoulder extending transversely of the shank, the head having a smaller width than the shoulder.

In a still further aspect, the invention provides a method of manufacturing a structural panel comprising the steps of:

fabricating a structural frame of interconnected structural members;

placing the structural frame in a mould; and injecting insulation material into the mould so that the insulation extends at least to the depth of the structural frame; and allowing the insulation to cure.

In one embodiment, the invention comprises the further step of connecting wall tie brackets to the structural members, and wherein the insulation is injected to the total depth of the structural members and the brackets.

In another embodiment, the mould is shaped to provide an outer surface of the insulation flush with outer faces of the brackets, and an inner surface of insulation flush with surfaces of the structural members.

In a further embodiment, the insulation is EPS.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawings in which.

DESCRIPTION OF THE EMBODIMENTS

Figure 1:
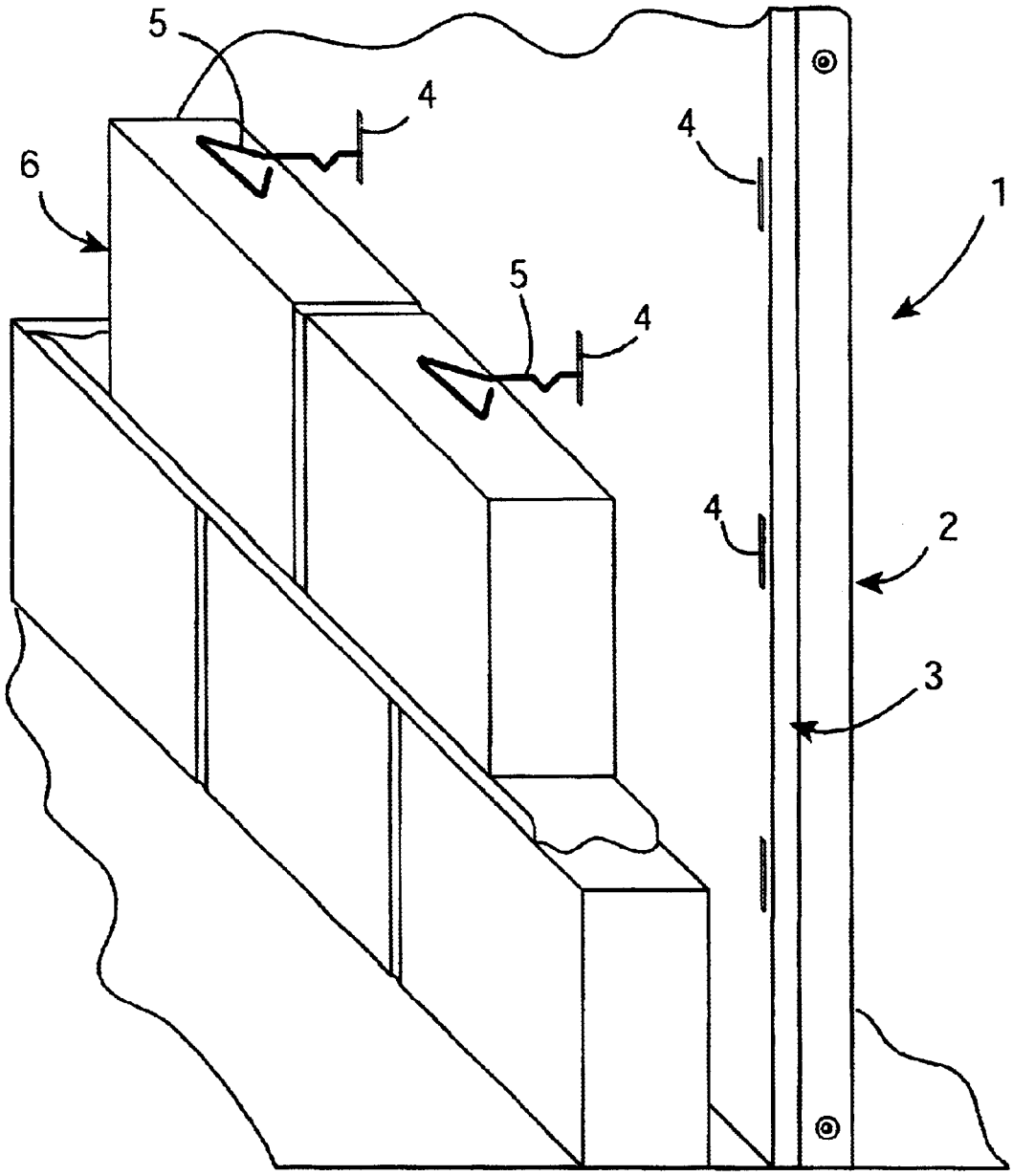
FIG. 1 is a perspective view from above showing a structural panel of the invention being used for construction of a double leaf wall.
Figure 3:
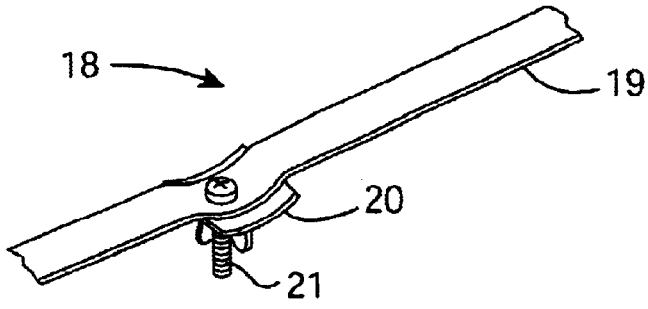
FIG. 3 is a detailed view of a brace tensioner.
Figure 2:
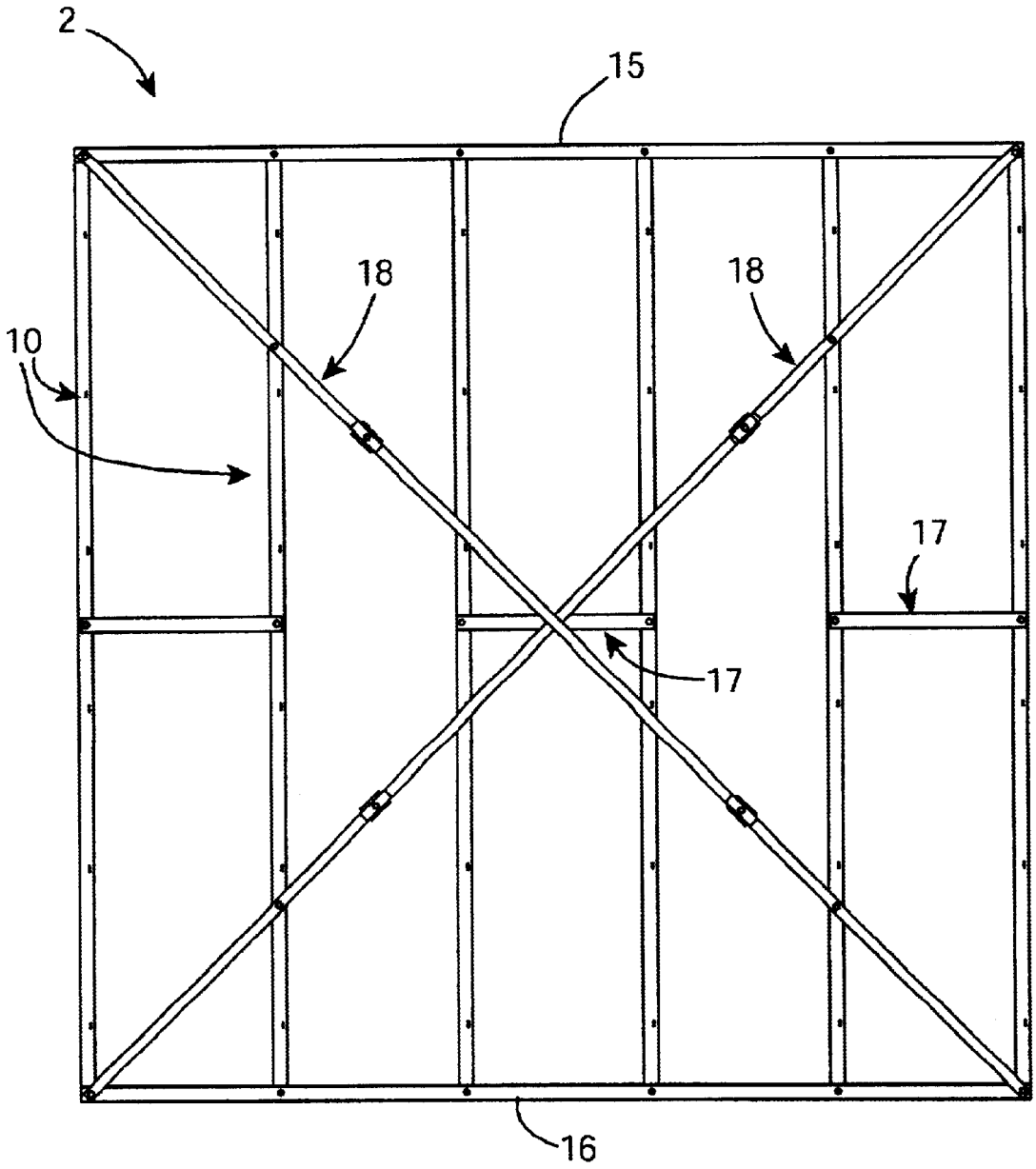
FIG. 2 is a front view of a structural frame of the element.

Referring to FIG. 1, a structural panel 1 comprises a structural frame 2 of cold-rolled steel material and integrally moulded expanded polystyrene (EPS) insulation 3. Wall tie brackets 4 are connected according to a grid pattern to the frame 2, and their outer faces are flush with the insulation 3 in the outer surface of the panel 1. The brackets 3 are described in more detail below. Wall ties 5 are connected to the brackets 4 to span a cavity as a block outer wall leaf 6 is being built.

The structural frame 2 is shown in more detail in FIGS. 2 to 6. In elevation, it comprises uprights 10 which have slots 11 and which extend between a horizontal top rail 15 and a horizontal bottom rail 16. Some of the uprights 10 are interconnected by nagging rails 17. The frame 2 also comprises a pair of diagonal braces 18, each having a flat steel bar and two tensioners. Each tensioner comprises a hardened steel curved fixture 20 and a tensioning bolt 21 for pulling the bar 19 into the shape of the fixture 20 to apply the desired tension.

Figure 4:
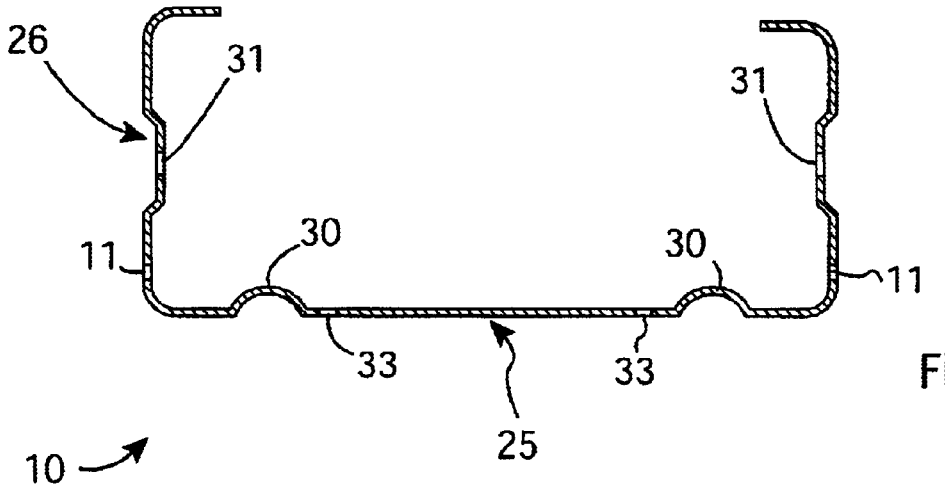
FIG. 4 is a cross-sectional view through an upright of the frame.
Figure 5:
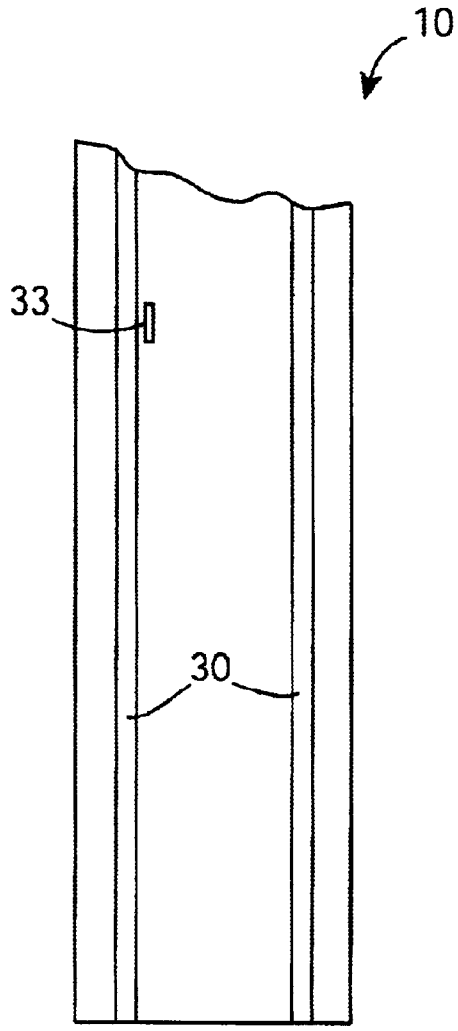
FIG. 5 is a side view of the upright.

Referring to FIGS. 4 and 5, each upright 10 comprises a web 25 and a pair of flanges 26. The slots 11 are in both of the flanges 26, although only one side is used. The web 25 comprises two stiffening ribs 30 extending along its length. The flanges 31 comprise pressed "dimples" at their ends.

Figure 6:
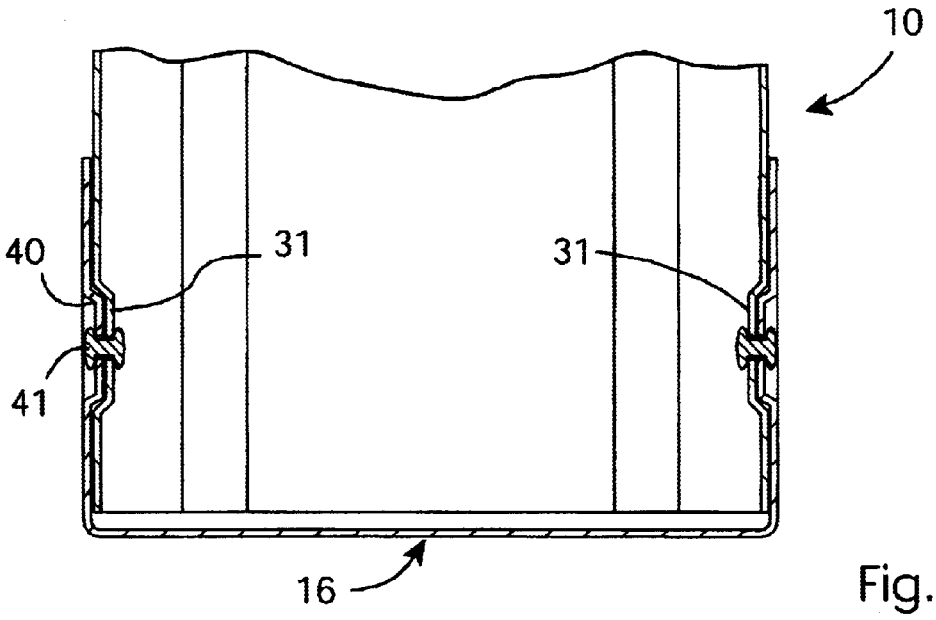
FIG. 6 is a cross-sectional view illustrating interconnection of an upright with a bottom rail.
Figure 7:
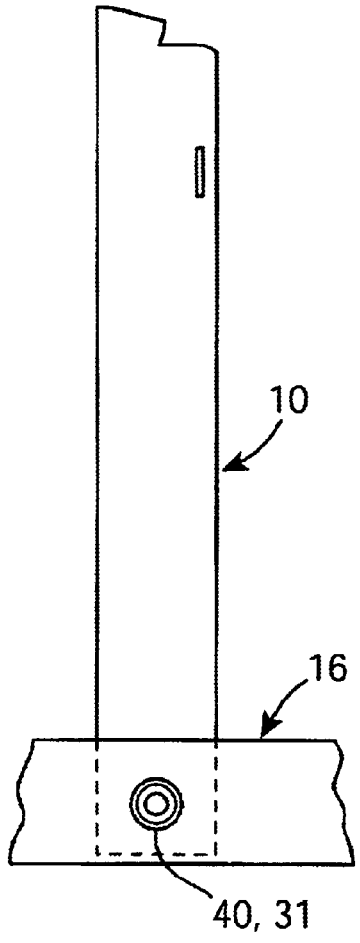
FIG. 7 is a front view.

Referring to FIGS. 6 and 7, the bottom rail comprises a flat web and a pair of flanges which are flat and have corresponding dimples 40. For interconnection, the upright 10 is simply push-fitted into the bottom rail 16 between the rail's flanges so that the dimples 31 and 40 snap fit into each other. They are then riveted, and a rivet 41 is illustrated. As shown in FIG. 7, because the rail flanges are flat (without ribs or turned-in rims) the upright 10 is connected with a simple push-fitting action.

The top rail 15 is similar to the bottom rail 16 and it is connected to the uprights in similar position. The nagging rails 17 are similar to the top and bottom rails 15 and 16. They are connected to the uprights at extensions of their flanges.

Figure 8:
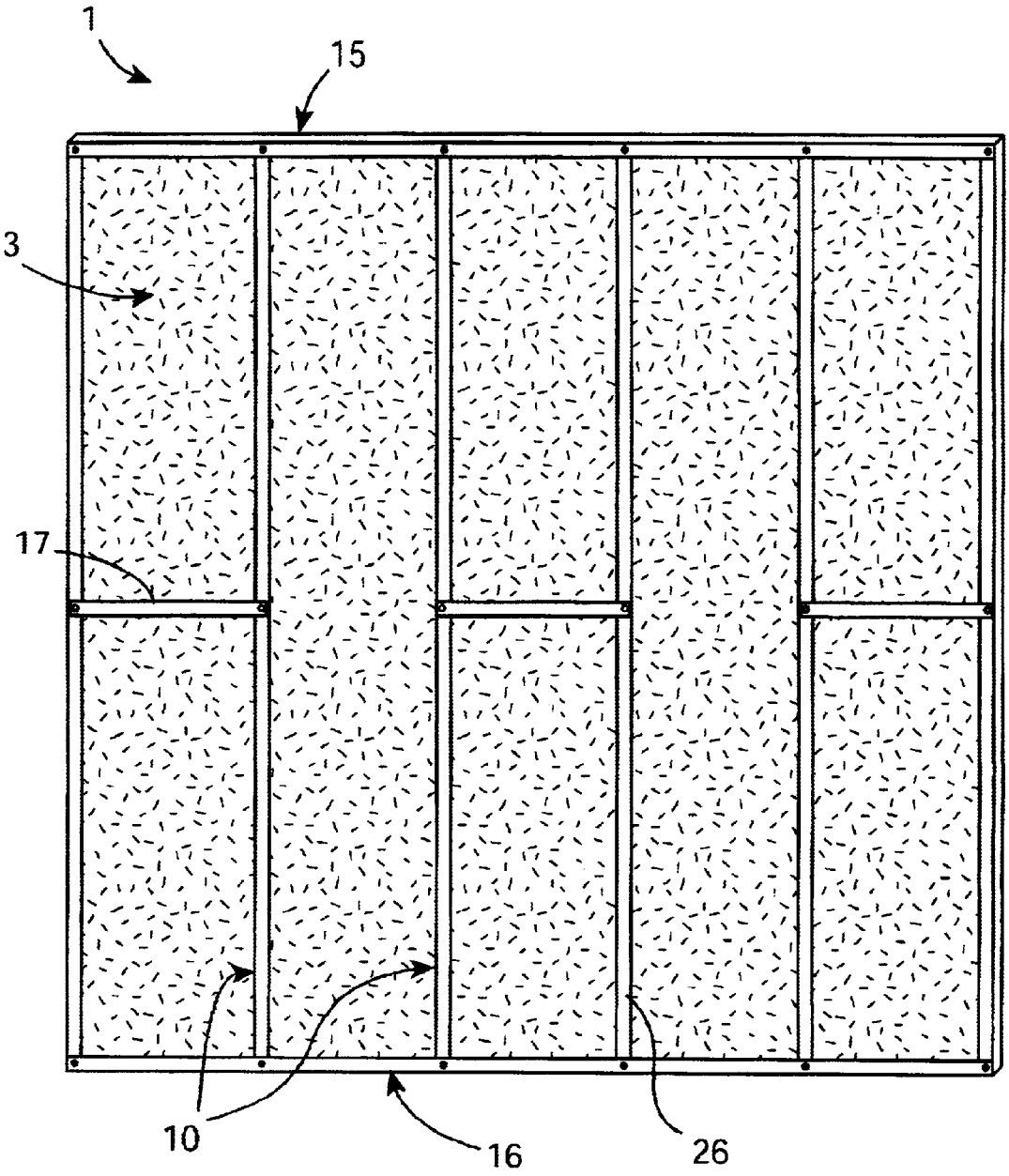
FIG. 8 is an elevational view of the panel, showing an inner surface.

Referring to FIG. 8, a complete panel 1 is shown in elevation at its inner side. On this side, a flange 26 of each upright 10 is flush with the EPS 3.

Figure 9:
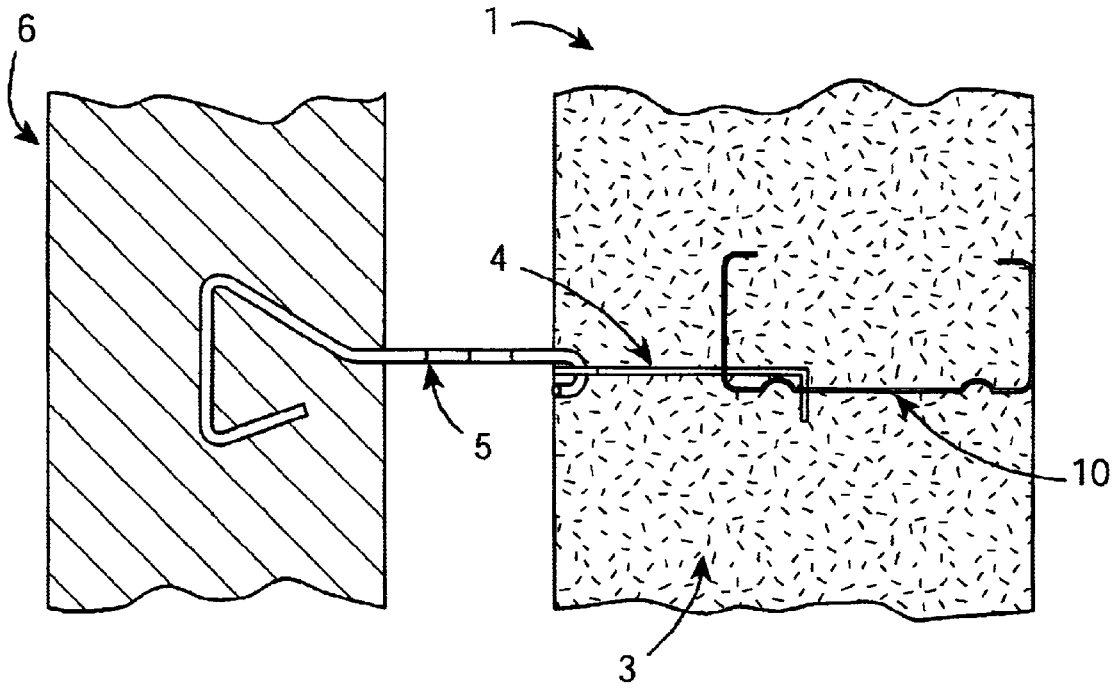
FIG. 9 is a cross-sectional plan view showing connection of the panel with a masonry wall leaf.
Figure 10:
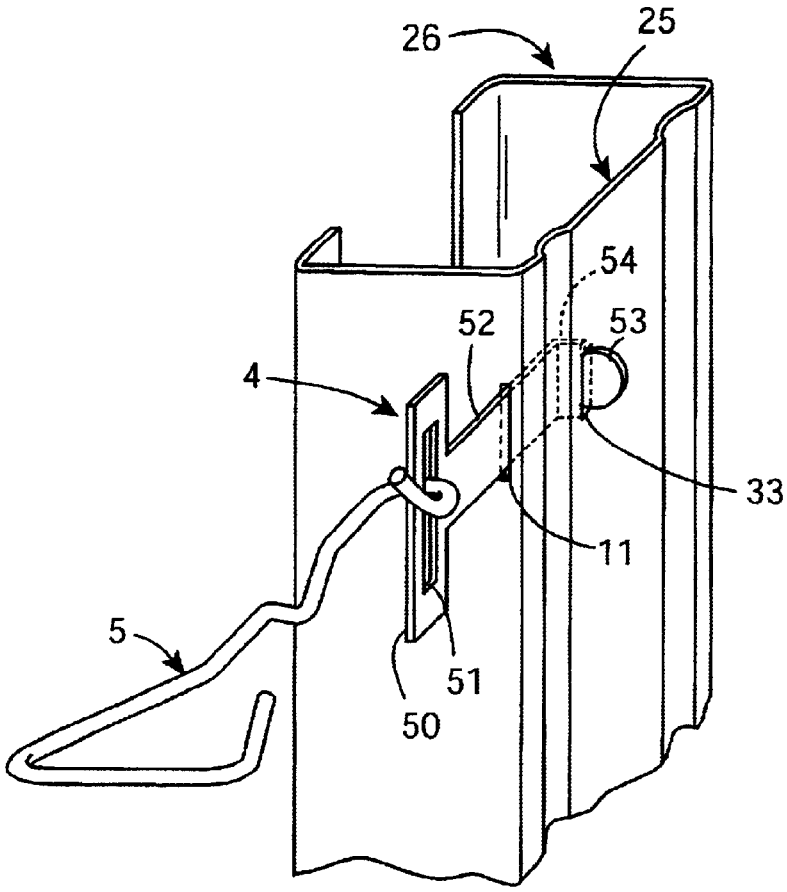
FIG. 10 is a perspective view showing how a bracket is connected to an upright, and how a wall tie is connected to the bracket.
Figure 12A:
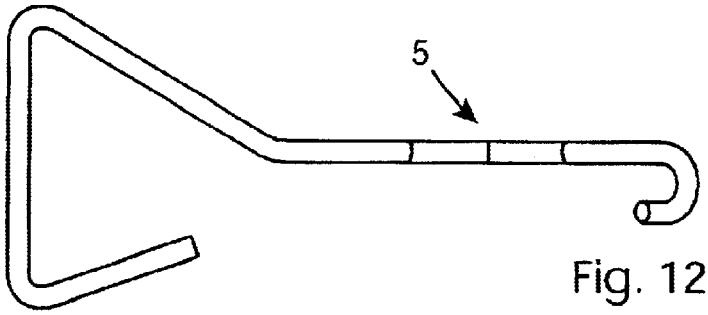
FIG. 12 is a set of views showing the wall tie in more detail.
Figure 12B:
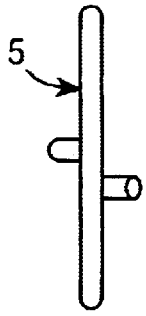
Figure 12C:
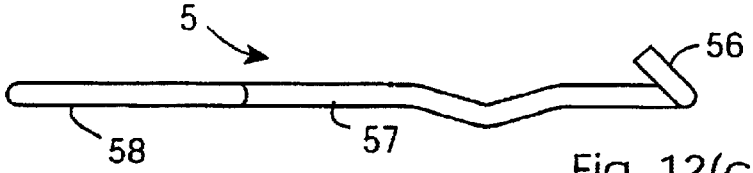
Figure 12D:
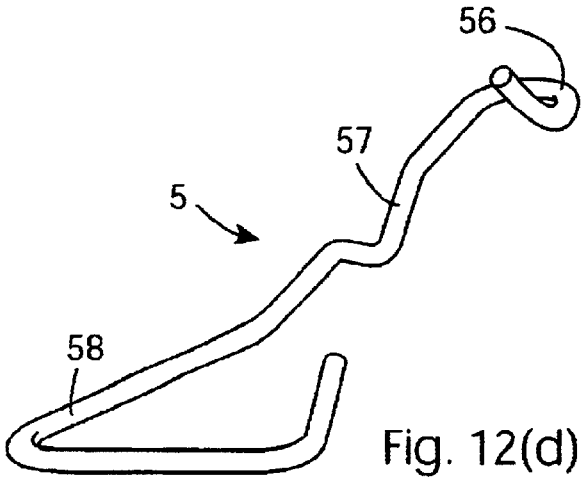
Figure 11A:
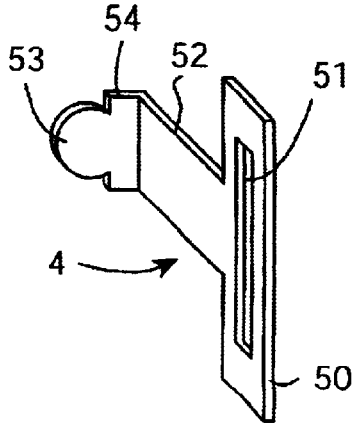
FIG. 11 is a set of views illustrating the bracket in more detail.
Figure 11B:
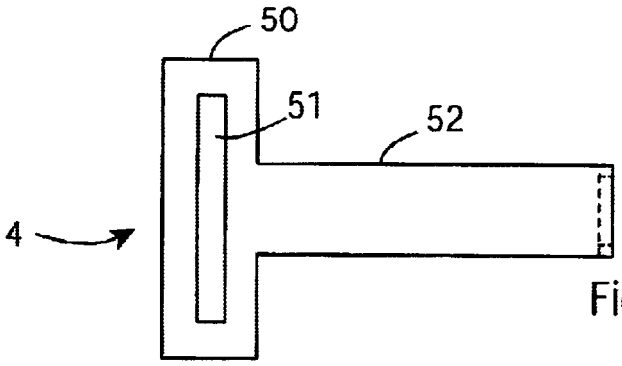
Figure 11D:
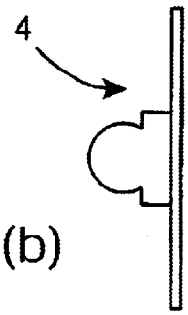
Figure 11C:
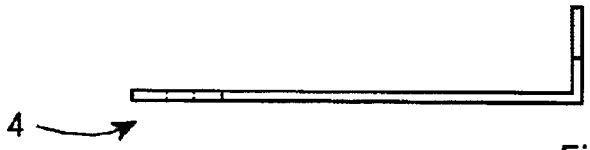

Referring to FIGS. 9 and 10, each bracket 4 comprises an outer end 50 having a vertical slot 51. A shank 52 extends through a slot 11 in a flange 26 of an upright 10. An inner end of the bracket 4 comprises a head 53 of semi-circular shape and a shoulder 54 which is 3 mm wider than the head 53. The head 53 fits through a slot 33 in the web 25, but the shoulder 54 is too wide and so abuts against the web 25 at its inner surface. This arrangement secures the bracket in place very effectively, and also allows simple assembly because it only requires the bracket 4 to be pushed into position. Another advantage is that by choice of location of the slot 33 one can easily set the extent to which the brackets 4 protrude from the frame 2. Indeed, the upright may have a series of slots 33 to allow choice after fabrication of the upright. This feature is probably most clearly illustrated in FIG. 9. This drawing also clearly shows the depth of the insulation 3:the total depth of the frame 2 and the brackets 4. Thus, there are no protruding parts and so panels 1 may be easily and safely transported and handled. Another important advantage is that there is minimal metal-to-metal contact ("cold bridge") across the cavity. The bracket 4 only contacts the upright 10 at the (very narrow) lower side edges of the slots 11 and 33. Also, there is only point contact between the wall tie 5 and the bracket 4. The bracket 4 is shown in more detail in FIGS. 11(*a*) to 11(*d*).

The wall tie 5 is shown in more detail in FIGS. 12(*a*) to 12(*d*). It is shaped from a unitary length of wire to form a hook 56, a shank 57 with a water-drip kink, and a mortar-engaging triangular outer end 58. The hook is upturned at its end. Thus, it can easily connected to a bracket 4 in a twisting action in which a small amount of insulation is removed as the hook 56 is pushed into position.

Figure 13:
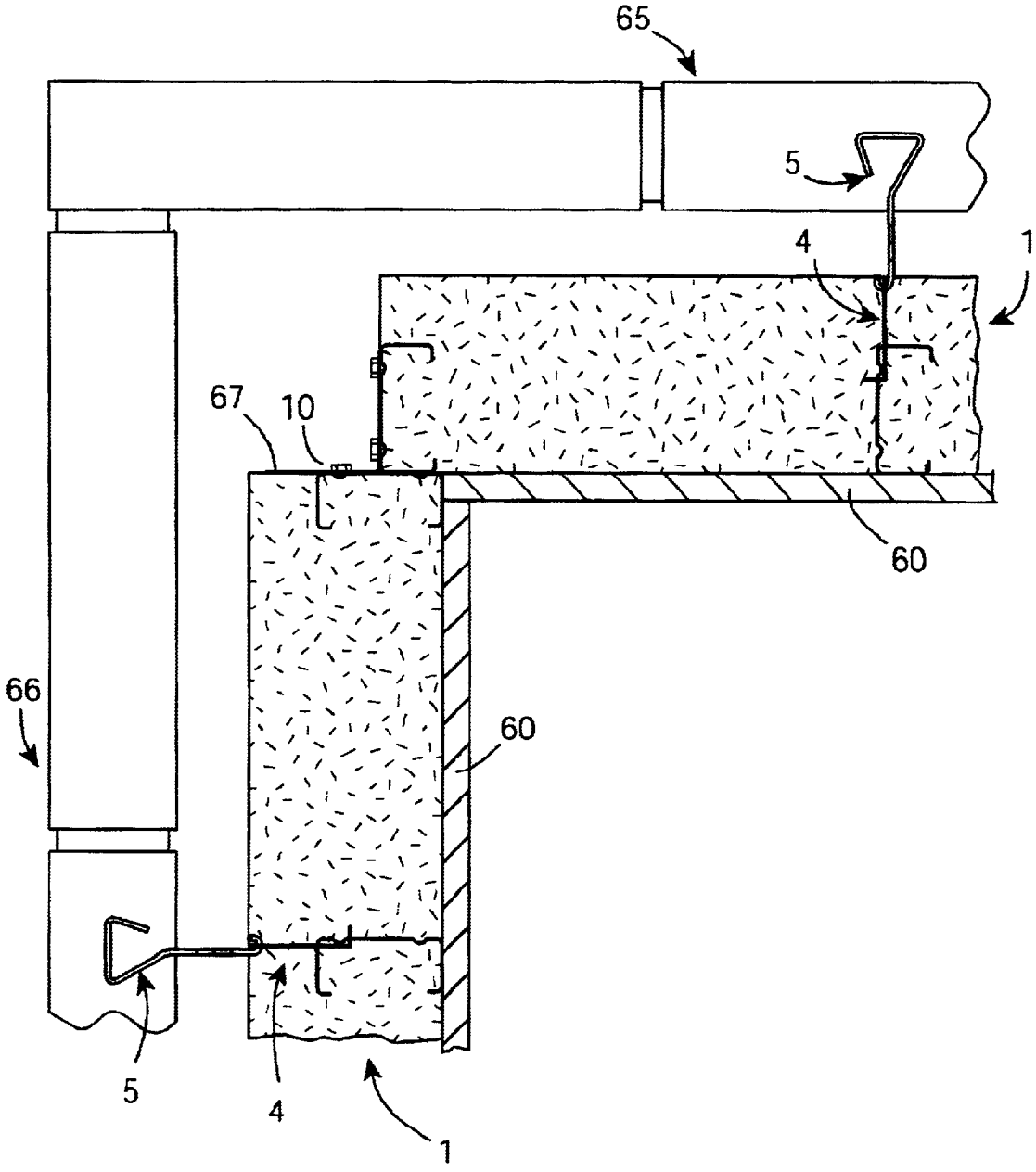
FIG. 13 is a diagrammatic plan view showing how panels may be used at a corner where walls adjoin.

A panel 1 is manufactured by fabricating a frame 2 as described, connecting brackets 4 to it, and placing it in a mould. EPS is injected to fill the mould around the frame 2 to provide the depth illustrated in FIG. 9. The moulds are changed from batch to batch to produce panels of the required sizes, and with or without opes. Also, a single panel may be manufactured to provide a full wall inner leaf of a building In use, panels 1 are shipped to a construction site and are interconnected end-to-end by fasteners. The panels are interconnected at a corner as shown in FIG. 13 in which outer leaves 65 and 66 adjoin. Gypsum panels 60 are connected to the panels 1 at their inner surfaces. An angle member 67 interconnects adjoining panels. As shown in FIG. 1, an outer masonry wall leaf 6 is built in conventional manner, with the wall ties 5 bridging the cavity as illustrated.

When a wall has been built, an upper floor is constructed using a generally Z-shaped floor support 70. The floor support 70 comprises a lip 71 and a top flange 72 which hook onto the top of a panel 1, with a vertical web 73 abutting the panel 1 at its inner surface. The web 73 terminates in a ledge 74 extending horizontally. The floor support 70 also comprises a series of rectangular cut-out tabs 75 extending outwardly and leaving cut-out apertures 77. Each tab 75 has a pair of bolt holes 76. A series of joists 80 are then rested on the ledge 74 and bolted to the tabs 75 as shown in FIG.

Figure 16:
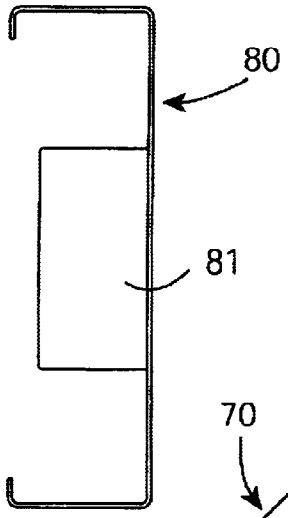
FIG. 16 is an end view of a joist.

15. Each joist 80 (as shown in FIG. 16) is C-shaped and has a series of cut-out tabs 81, leaving cut-out apertures 82.

Figure 15:
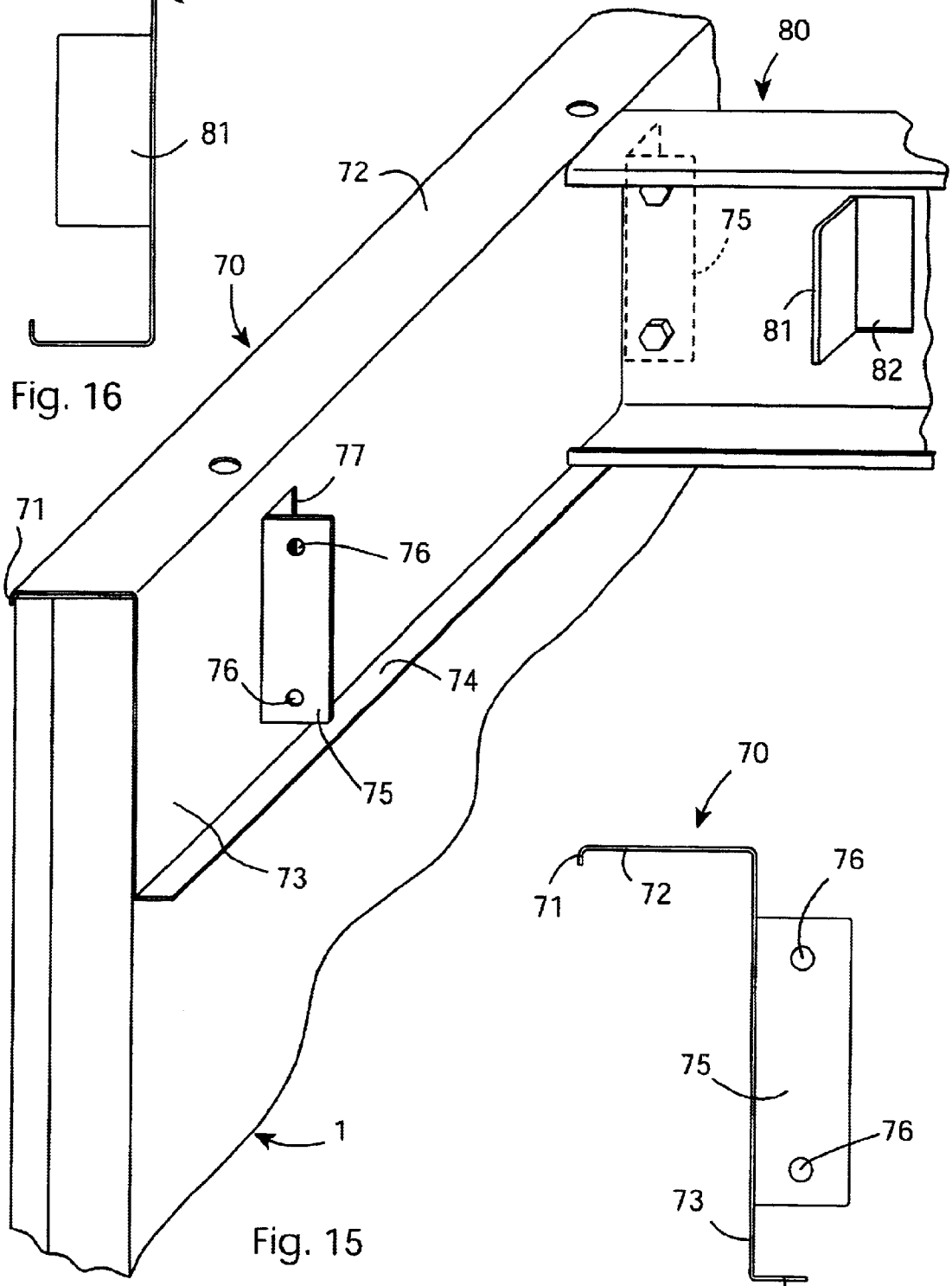
FIG. 15 is a perspective view of the top of an element and how it supports joists.
Figure 14:
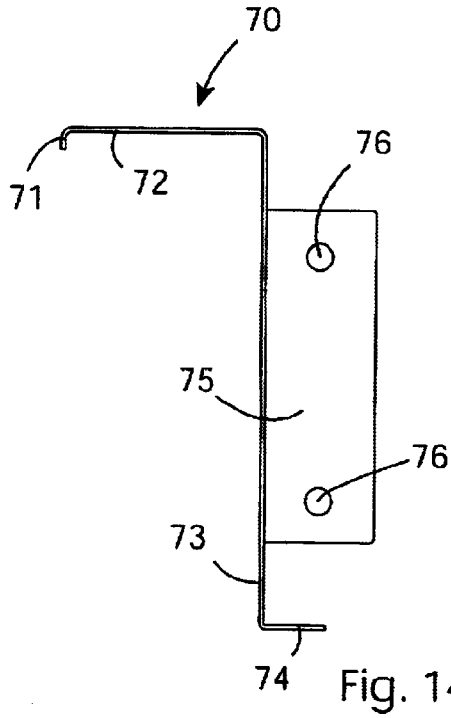
FIG. 14 is an end view of a joist support.

The assembly illustrated in FIG. 15 has the major advantage of providing full insulation through the ceiling level and through to the top of the joists 80. The prior approach has been to rest joists on the wall, thus leaving an insulation gap immediately above the wall. Another advantage is that floor assembly is very simple and quick, again minimising labour required. A still further advantage is that cable ducting is easily provided by removing EPS behind the cut-out apertures 77 to complete a path along a joist and possibly through joist cut-out apertures 82.

It will be appreciated that the invention provides constructional elements which greatly reduce on-site manpower requirements, provide excellent structural strength, and provide excellent insulation, without one sacrificing the other. Heretofore, improved insulation has been achieved at the expense of structural strength. It will be also be appreciated that the elements integrate with conventional wall leaf construction methods so that the benefits of both can be achieved.

The invention is not limited to the embodiments described but may be varied in construction and detail. For example, the frame material may alternatively be of a different structural-strength material such as aluminium.

What is claimed is:

1. A structural assembly comprising:

a structure panel including structural members and integrally moulded insulation, the structural members being interconnected independently of the insulation as a structural frame;

an elongate floor support suspended from the panel along an upper side edge of the panel, the suspended support including a vertical web abutting against an inner surface of the panel, a top flange extending across a top side edge of the panel and terminating in a lip extending downwardly;

joists connected to the suspended support and extending transversely from the plane of the panel; and a ledge extending horizontally from the vertical web, said joists resting on the ledge.

2. The structural assembly as claimed in claim 1, wherein the vertical web comprises a plurality of cut-out tabs extending from the vertical web and each being secured to a joist.

3. The structural assembly as claimed in claim 2, wherein the assembly comprises a cable duct extending through tab cut-out apertures and insulation in the panel.

4. A structural frame comprising:

structural members interconnected together and at least some structural members including a web and a pair of flanges;

a wall tie including a mortar-engaging outer end;

a shank; and an inner end comprising a hook shaped for engagement in a slot of a wall tie bracket; and a wall tie bracket including an outer end comprising a slot for engagement with the wall tie;

a shank; and an inner end comprising a head and a shoulder extending transversely of the shank, the head having a smaller width than the shoulder, each wall tie bracket extending through a flange and a web of a structural member, in which the head of the bracket extends through the web and the shoulder abuts against the web.

5. A structural frame comprising:

structural members interconnected together and at least some structural members including a web and a pair of flanges;

a wall tie bracket including an outer end comprising a slot for engagement with a wall tie;

a shank; and an inner end comprising a head and a shoulder extending transversely of the shank, the head having a smaller width than a width of the shoulder, each wall tie bracket extending through a flange and a web of a structural member, in which the head of the bracket extends through the web and the shoulder abuts against the web.

* * * * *